US006425230B2

(12) United States Patent
Völlmecke et al.

(10) Patent No.: US 6,425,230 B2
(45) Date of Patent: Jul. 30, 2002

(54) STIRRUP

(75) Inventors: Valentin Völlmecke; Heinz Baumann, both of Iserlohn (DE)

(73) Assignee: Herm. Sprenger GmbH & Co. KG (DE)

( * ) Notice: Subject to any disclaimer, the term of this patent is extended or adjusted under 35 U.S.C. 154(b) by 0 days.

(21) Appl. No.: 09/897,688

(22) Filed: Jul. 2, 2001

Related U.S. Application Data

(63) Continuation of application No. PCT/DE00/00473, filed on Feb. 19, 2000.

(30) Foreign Application Priority Data

Feb. 26, 1999 (DE) ..... 199 08 390

(51) Int. Cl.[7] ..... B68C 3/00
(52) U.S. Cl. ..... 54/48
(58) Field of Search ..... 54/47, 48

(56) References Cited

U.S. PATENT DOCUMENTS

| | | | | | |
|---|---|---|---|---|---|
| 33,354 | A | * | 9/1861 | Livingston | 54/48 |
| 202,974 | A | * | 4/1878 | Wiley | 54/48 |
| 4,936,081 | A | * | 6/1990 | Jones | 54/48 |
| 5,172,538 | A | * | 12/1992 | Luger | 54/47 |

FOREIGN PATENT DOCUMENTS

| | | | |
|---|---|---|---|
| DE | 3933205 | * | 5/1990 |
| FR | 404238 | * | 11/1909 |

* cited by examiner

*Primary Examiner*—Robert P. Swiatek
(74) *Attorney, Agent, or Firm*—Akerman Senterfitt

(57) ABSTRACT

The stirrup has a crossbar that supports a rider's shoe in riding. The stirrup further has an upper portion that is provided with a fastener for a carrying belt of the stirrup. The stirrup also has a damping body, which is arranged on the stirrup between the crossbar and the rider's shoe.

36 Claims, 2 Drawing Sheets

STIRRUP

CROSS-REFERENCE TO RELATED APPLICATIONS

Figure 1:
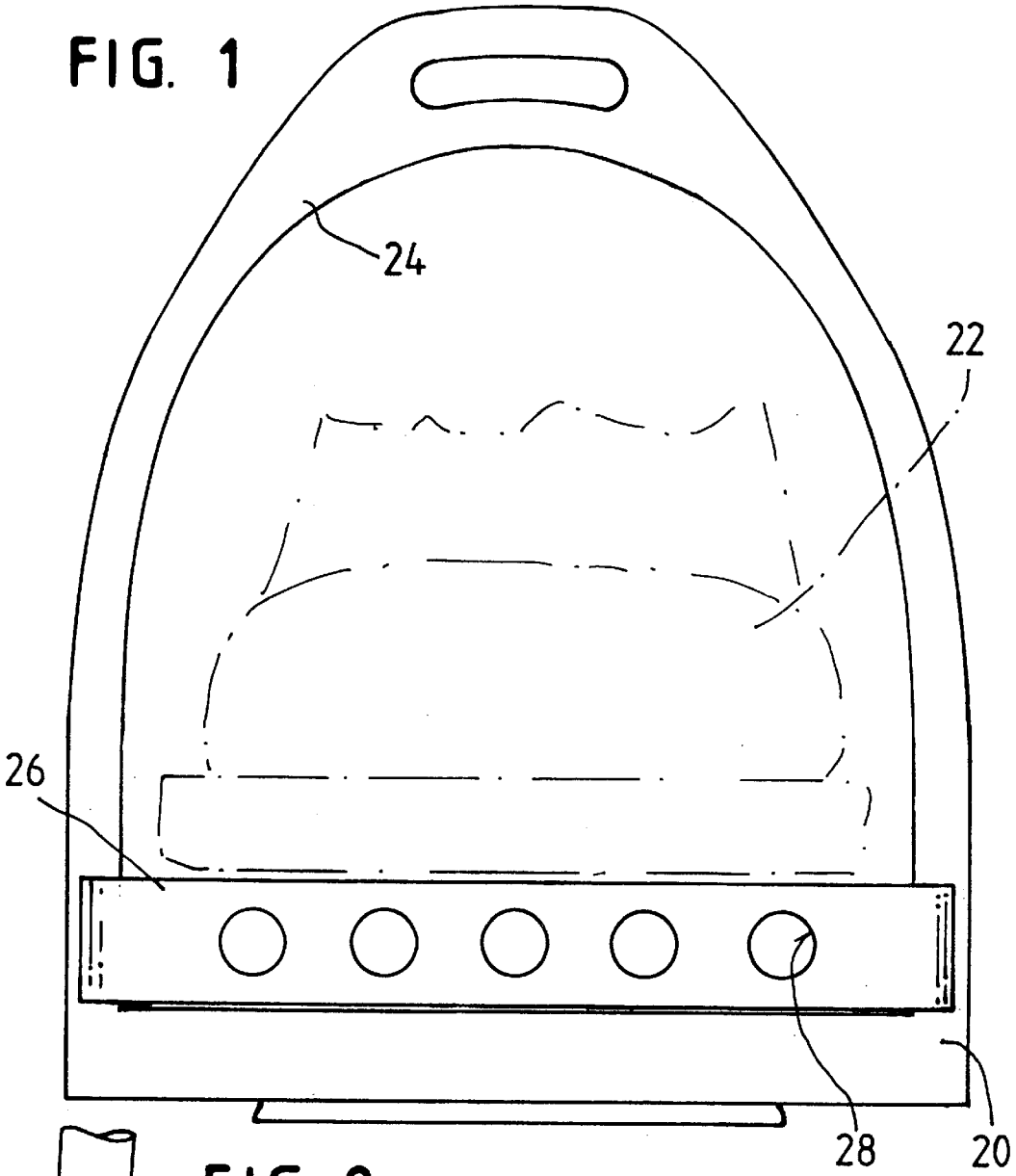

This is a continuation of PCT International Application No. PCT/DE00/00473, filed Feb. 19, 2000.

The invention relates to a stirrup with a crossbar that supports the rider's shoe in riding and with an upper portion that is provided with a fastening means for a carrying belt of a stirrup.

The stirrup of the type mentioned above is conventional in this art. Typically, it has a metal part made of one piece that forms the upper portion as well as the metallic area of the crossbar and a resting element that is pressed into a longitudinal slot of the metallic part of the crossbar. This resting element is an elastomer block with a mushroom-shaped extension that protrudes downward and that may be elastically compressed, a longitudinal slot being provided for this purpose. It may thus be removably pressed into the metallic part of the crossbar, although considerable force has to be exerted to remove it.

This previously proposed resting element of the crossbar is made of a relatively hard rubber. It is provided on its surface with nubs that are protruding upward and are positioned at regular intervals. Although it has a certain spring characteristic, it is a small one and the damping capacity is negligibly small as well.

Recently, stirrups have repeatedly been equipped with a damper. So it has been known in the art to arrange a dashpot directly on the fastening means of the upper portion of the stirrup, and, more precisely, between said stirrup and the stirrup leather, said dashpot being designed to resemble a shock absorber as it is known to be used in vehicles. This dashpot is approximately 2 to 3 cm in diameter and about 8 to 15 cm in length. It allows to dampen abrupt motions of the stirrup and of the rider it supports. It has a considerable disadvantage, though. Its mass is comparable with and generally superior to the mass of the stirrup itself. As a result thereof, the center of gravity of the unit constituted by the stirrup and the dashpot is rather determined by the latter which means to say that the common center of gravity is relatively high. This has considerable disadvantages in practical riding. Moreover, the relatively large dashpot is not aesthetic. A motion takes place relative to the horse which disturbs the horse. All this is disadvantageous.

Accordingly, the object of the invention is to develop the stirrup of the type mentioned above in such a manner that a good damping capacity is obtained without having the center of gravity of the stirrup displaced upward and that the measures for damping are simple and may be, as far as possible, carried out with exchangeable dampers.

Starting from the stirrup of the type mentioned herein above, this object is achieved by having a damping body arranged on the stirrup between the crossbar and the shoe.

The invention accordingly proposes to develop and design the resting body of the art in such a manner that it is an efficient damping body. By efficient damping body a body is meant that, in a way similar to a shock absorber in a vehicle, deflects much more readily than it rebounds, i.e., that converts kinetic energy into other kinds of energy, more specifically into heat, and that in any case is as little elastic as possible. A so-called elasticoviscous behavior for example is aimed at.

The damping body according to the invention that is arranged on the crossbar has considerable advantages over the dashpot that has been described in detail. The mass of this damping body is situated underneath the rider's foot, the stirrup continuing to fall downward in a natural way, attracted by gravity, as a result thereof, maintaining this position in an even more advantageous manner than the stirrup of the type mentioned above. Tilting, which occurs with the stirrup provided with a dashpot, is impeded.

Dampening elastomer materials as they are utilized in so-called safety plates that are laid on playgrounds in the area of such play structures from which children may fall down, such as climbing frames for example, are known in principle. Such safety plates are typically composed of a mixture of shredded reclaimed rubber, from tires for example, and of an adhesive such as polyurethane for example. By mixing two different materials, i.e., rubber shreds, e.g., ground rubber, and PU, more specifically polyurethane foam, an inhomogeneous body is obtained that has good shock absorbency. Such materials as well as the instruments for testing them are well known.

It furthermore proved advantageous to provide the damping body with internal hollow spaces that run across the direction of load for example. Such internal hollow spaces also permit to achieve non homogeneity of the material constituting the body, which influences favorably the absorption properties of impacts. These internal hollow spaces are preferably visible and open across the direction of the opening of the stirrup. It is therefore easy to distinguish the damping bodies from the resting elements of the art.

While the resting elements of the art are relatively difficult to remove from the metallic crossbar, the development suggests removably connecting the damping body to the metallic crossbar so that the damping body may be removed from the metallic crossbar without the help of any tool and with forces so small that even, e.g., a child may gather them. This may be performed by having the damping body and the metallic crossbar joined together by Velcro fasteners for example. Such a connection proved to be resistant enough not to unfasten in practical use. On the other hand it is so easy enough to free as to allow a quick exchange of a damping body. In a preferred embodiment, the damping body is connected by its lower surface with a first part of a Velcro fastener. The second part of the Velcro fastener is attached to the upper side of the crossbar.

It furthermore proved advantageous to give the damping body a desk-shaped cross section. A slant resting surface for a rider's sole is thus achieved. As a result thereof, a rider is better capable of adjusting the stirrup to his own wishes and to his own riding behavior.

In another embodiment, the damping body is realized by a resting plate for the foot and by a shock absorber as it is known from the automotive industry. The other end of said shock absorber is attached to the crossbar of the stirrup.

In another further embodiment, there is arranged on the crossbar a cushion filled with a fluid, said cushion cooperating with a second cushion situated underneath the crossbar through small bores that are partially provided with valves. The fluid is also contained in said second cushion. Depending on the ratio of forces, the fluid is pressed from the upper into the lower cushion. This flow is quite fast on account of the valves. The flow running countercurrent to the first one takes quite some time though, since here, the valves shut several of the small gates or throats.

Further characteristics and advantages of the invention will become apparent in the remaining claims as well as in the following description of exemplary embodiments that are not limiting the scope of the invention. Said embodiments are explained in more detail with reference to the drawing.

Figure 2:
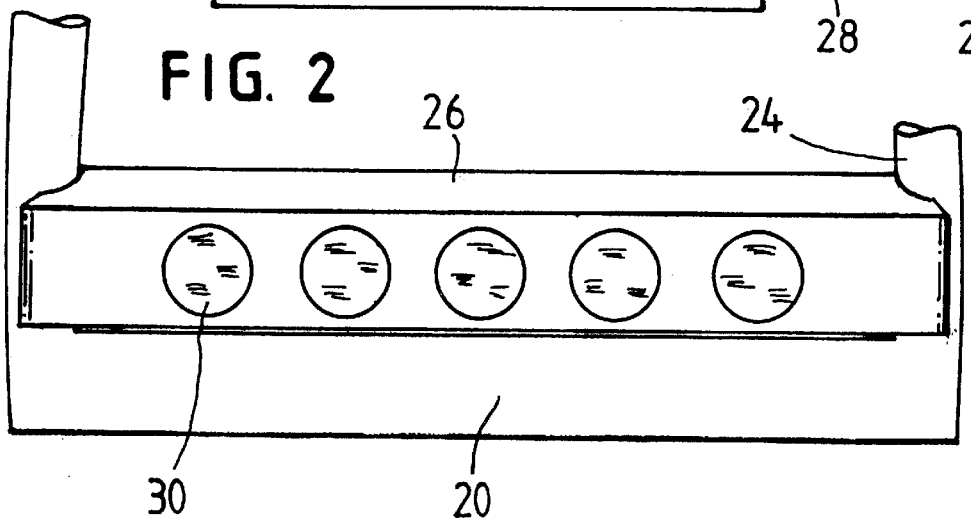
Figure 3:
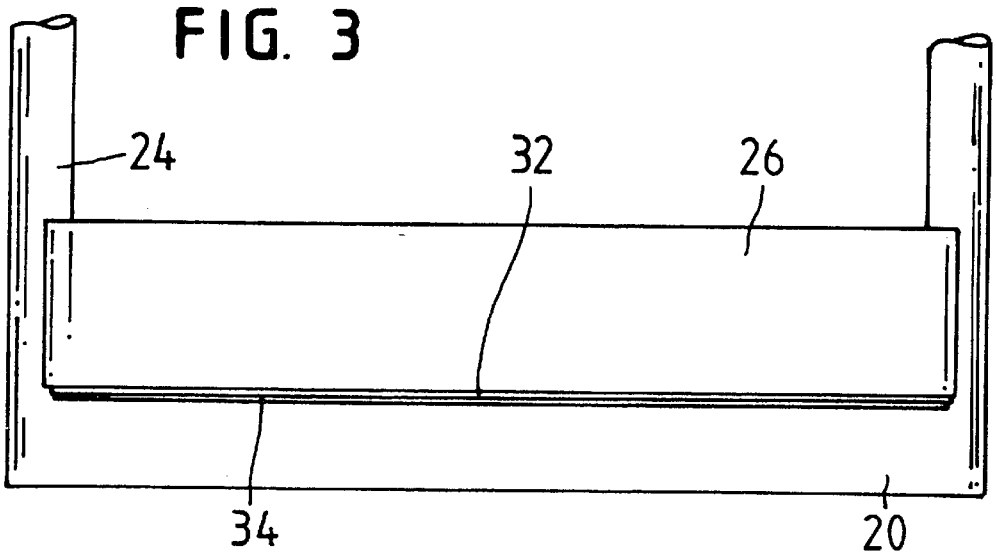
Figure 4:
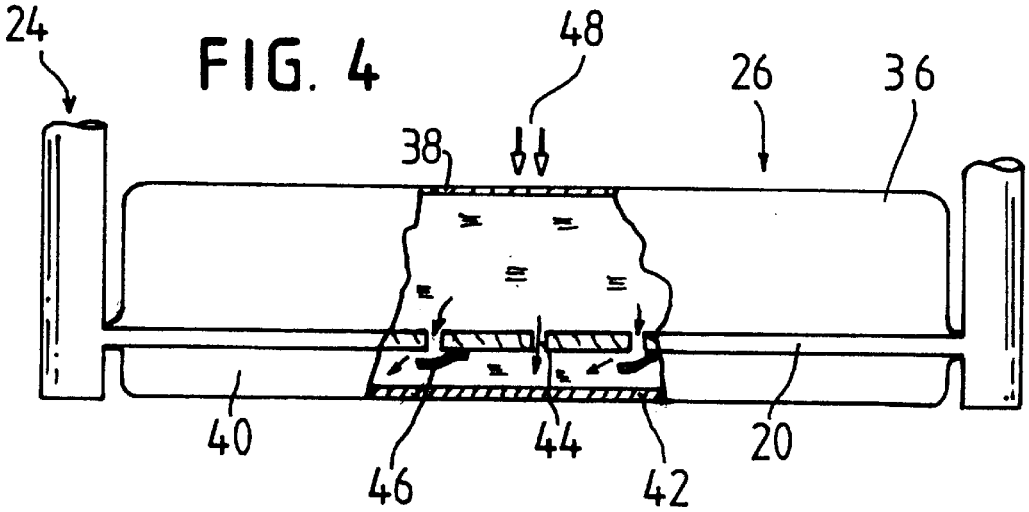
Figure 5:
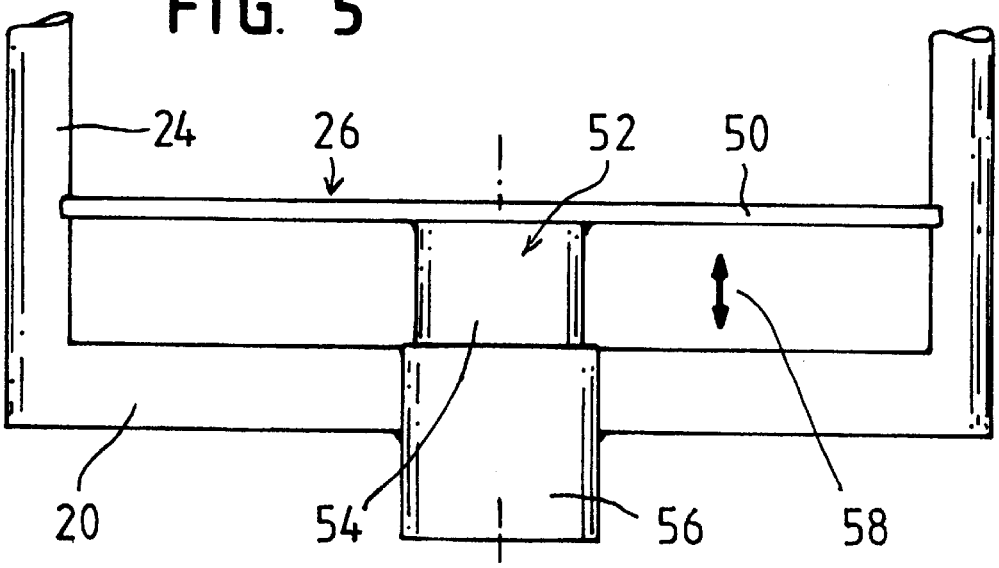

FIG. 1: is a view of a stirrup with a damping body that is designed as a resting element made of elastomer material with bores, FIG. 2: is a partial view of a stirrup according to FIG. 1, but this time it has been given the shape of a desk and is provided with energy-absorbing bodies in the form of cylinders that are filled with fluid and are provided with an elastic hermetic envelope, FIG. 3: is a representation of the lower part of a stirrup according to FIG. 1, this time with a damping body in the form of a block made of a mixture of polyurethane and ground rubber, FIG. 4: is a representation according to FIG. 3, but this time with a damping body designed as two communicating cushions that are accommodated on the upper and on the lower side of the crossbar and FIG. 5 is a representation according to FIG. 3, but this time with a damping body designed as a resting plate for the foot and with a shock absorber connected to said resting plate, said shock absorber being in turn attached to the crossbar.

As shown in FIG. 1, the stirrup has a crossbar 20. The crossbar 20 supports a rider's shoe 22 in riding. The stirrup is furthermore provided with an upper portion 24 that forms, among others, two side legs and is provided with a fastening means, designed here as a long hole, for a supporting belt (not illustrated in the drawing herein). A damping body 26 is accommodated between the shoe 22 and the crossbar 20. In the embodiment according to FIG. 1 it is made of that material, i.e., rubber, that is also utilized in the resting element of the stirrup of the art, with the difference that here, a total of five bores 28 is additionally provided, said bores running parallel to each other across the surface of the opening at regular intervals. Furthermore, the thickness of the damping body is preferably superior to the thickness of the resting element of the art which is of approximately 20 mm, it may now range between 23 and 40 mm.

Tests have been made with a pressure gauge in order to determine the effect of different diameters of the through bores 28 on damping. A damping body 26, 22 mm thick and provided with five traversing bores 28 was assumed. The test yielded that, on applying a load of 50 kg, the damping bodies with bores deflect and dampen much better. With bores 8 mm in diameter, deflection was about 50% stronger as compared to a resting element of the art. With bores 12 mm in diameter, deflection was even increased by 85%, damping increasing accordingly. Similar values were obtained with a load of 100 kg. Quite good values, situated between the values for five bores 8 mm and five bores 12 mm, were obtained with nine staggered pocket holes 9 mm in diameter. The bores render the body inhomogeneous, damping increases as a result thereof.

In the embodiment according to FIG. 2, five through bores 28 are again provided in a damping body 26 made of rubber, but this time, the bores 28 are filled with energy-absorbing bodies 30, five of them being provided for. They are cylindrical, closed envelopes made of an elastic material, more specifically of plastic foil or rubber foil. The interior of the energy-absorbing bodies is filled with a fluid such as oil for example. On exerting pressure onto the damping body 26, the bores 28 deform, causing the fluid to move in the energy-absorbing bodies, energy being absorbed in the process.

FIG. 2 shows another feature that is independent of the arrangement of the energy-absorbing bodies 30 in the bores 28: the surface of the damping body 26 no longer runs parallel to the crossbar 20, but slantways. In other words, the damping body 26 has the shape of a desk. As a result thereof, the resting surface supporting the shoe 22 is oblique, which is what many a rider wishes.

In the embodiment according to FIG. 3, a damping body 26 is provided that is made of a mixture of rubber parts, more specifically ground rubber, and polyurethane. The damping values desired are obtained by the appropriate mixture. The mixture used here is the same as the one utilized for safety plates on playgrounds.

Furthermore, in the embodiment according to FIG. 3, the damping body 26 is so connected to the crossbar 20 as to be readily removable. A first plane bonding agent 32 is provided which is preferably designed as a first part of a Velcro fastener. A second bonding agent 34 mating the first bonding agent 32 is spread on the upper side of the crossbar 20. This second bonding agent 34 preferably is the second part of a commercial Velcro fastener. The damping body 26 may thus be readily removed from the crossbar 20 and may be replaced by another damping body that has the shape of a desk, is flatter, has higher absorbing properties or so on.

In the embodiment according to FIG. 4, the damping body no longer is an elastomer body. Here, the upper side of a crossbar 20 having a narrower design is provided with a first cushion 36 that is defined by an elastic, hermetic envelope 38. On the other, lower side of the crossbar 20, a corresponding second cushion is provided that is delimited by an envelope 42 which is considerably stiffer than the envelope 38. The inner spaces of the two hermetic cushions 36, 40 communicate via gates 44 provided for in the crossbar 20. Only few of these gates 44 are designed as free gates as it is the case with the central gate in FIG. 4. Most of the gates have a valve which is represented by a valve flap in FIG. 4. Normally, the valve flap 46 is closed. If a force, as it is symbolized by the two arrows 48, acts on the upper side of this damping body 26 according to FIG. 4, the fluid contained in the first cushion 36 is forced into the second cushion 40. The valve flaps open on account of the pressure exerted by the fluid exiting the first cushion.

Once the load on the first cushion 36 has eased away, the fluid flows back into the first cushion 36. But now, the valve flaps 46 hamper the flow of fluid since the valve flaps 46 are self-shutting on one side and since, on the other side, they are kept closed anyway by the higher pressure of the fluid in the second cushion 40 as compared to the first cushion. As a result thereof, the return flow is substantially slower than the flow from the first cushion 36 into the second cushion 40.

The second cushion 40 has an envelope 42 that is elastic but stiffer than the envelope 38 of the first cushion 36. This makes certain that the initial state as it is illustrated in FIG. 4 is always returned to when no external forces are applied.

The fluid used is oil for example. The material for the envelopes 38, 42 may be the same for the two. As shown in FIG. 4, the envelope 42 is considerably thicker than the envelope 38, this being sufficient to obtain the required higher stiffness of the second envelope 42.

In the embodiment according to FIG. 5, the damping body has a plate 50 supporting a rider's shoe. The plate 50 is connected to a shock absorber 52 which is in turn arranged on the crossbar 20. Said shock absorber 52 has an inner tube 54 that is fastened to the plate 50 and an outer tube 56 that is attached to the crossbar 20. As shown in FIG. 5, the plate 50 is designed in such a manner that it laterally covers with play the legs of the upper portion 24. The motion is performed in the direction of the double arrow 58.

What is claimed is:

1. A stirrup, comprising:

a crossbar that supports a rider's shoe during riding;

an upper portion having fastening means for a carrying belt of said stirrup; and a damping body arranged on the stirrup between the crossbar and the rider's shoe, wherein said damping body deflects more readily than it rebounds;

wherein the damping body is made of an inhomogeneous material.

2. Stirrup according to claim 1, wherein the damping body is exchangeably and removably connected to the crossbar.

3. Stirrup according to claim 1, wherein the damping body is an elastomer block.

4. Stirrup according to claim 1, wherein the damping body is made of a material which has an elasticoviscous behavior.

5. Stirrup according to claim 1, wherein the damping body has a slope running crosswise to the crossbar.

6. Stirrup according to claim 1, wherein the damping body is a rubber block.

7. Stirrup according to claim 1, wherein the damping body is provided with inner hollow spaces.

8. Stirrup according to claim 7, wherein the inner hollow spaces run across the direction of a load caused by a rider's shoe.

9. Stirrup according to claim 1, wherein the damping body is substantially non-elastic.

10. Stirrup according to claim 1, wherein the damping body is exchangeably and removably connected to the crossbar.

11. Stirrup according to claim 1, wherein the damping body is an elastomer block.

12. Stirrup according to claim 1, wherein the damping body is made of a material which has an elasticoviscous behavior.

13. Stirrup according to claim 1, wherein the damping body has a slope running crosswise to the crossbar.

14. Stirrup according to claim 1, wherein the damping body is a rubber block.

15. Stirrup according to claim 1, wherein the damping body is provided with inner hollow spaces.

16. Stirrup according to claim 15, wherein the inner hollow spaces run across the direction of a load caused by a rider's shoe.

17. Stirrup according to claim 1, wherein the damping body is substantially non-elastic.

18. Stirrup according to claim 1, wherein the damping body is exchangeably and removably connected to the crossbar.

19. Stirrup according to claim 1, wherein the damping body is an elastomer block.

20. Stirrup according to claim 1, wherein the damping body is made of a material which has an elasticoviscous behavior.

21. Stirrup according to claim 1, wherein the damping body has a slope running crosswise to the crossbar.

22. Stirrup according to claim 1, wherein the damping body is a rubber block.

23. Stirrup according to claim 1, wherein the damping body is provided with inner hollow spaces.

24. Stirrup according to claim 23, wherein the inner hollow spaces run across the direction of a load caused by a rider's shoe.

25. Stirrup according to claim 1, wherein the damping body is substantially non-elastic.

26. Stirrup according to claim 1, wherein the damping body is exchangeably and removably connected to the crossbar.

27. Stirrup according to claim 1, wherein the damping body is an elastomer block.

28. Stirrup according to claim 1, wherein the damping body is made of a material which has an elasticoviscous behavior.

29. Stirrup according to claim 1, wherein the damping body has a slope running crosswise to the crossbar.

30. Stirrup according to claim 1, wherein the damping body is a rubber block.

31. Stirrup according to claim 1, wherein the damping body is provided with inner hollow spaces.

32. Stirrup according to claim 31, wherein the inner hollow spaces run across the direction of a load caused by a rider's shoe.

33. Stirrup according to claim 1, wherein the damping body is substantially non-elastic.

34. A stirrup, comprising:

a crossbar that supports a rider's shoe during riding;

an upper portion having fastening means for a carrying belt of said stirrup; and a damping body arranged on the stirrup between the crossbar and the rider's shoe, wherein the damping body deflects more readily than it rebounds;

wherein the thickness of the damping body is between approximately 23 and 40 mm.

35. A stirrup, comprising:

a crossbar that supports a rider's shoe during riding;

an upper portion having fastening means for a carrying belt of said stirrup; and a damping body arranged on the stirrup between the crossbar and the rider's shoe, wherein the damping body deflects more readily than it rebounds;

wherein the damping body has an upper surface on which the rider's shoe can rest during riding, the upper surface being substantially parallel to the crossbar, in a transverse direction.

36. A stirrup, comprising:

a crossbar that supports a rider's shoe during riding;

an upper portion having fastening means for a carrying belt of said stirrup; and a damping body arranged on the stirrup between the crossbar and the rider's shoe;

wherein the damping body has a plate surrounding the rider's shoe, wherein the damping body deflects more readily than it rebounds; and wherein the plate is connected to a shock absorber arranged on the crossbar.

* * * * *